US006431102B1

(12) United States Patent
Askestad et al.

(10) Patent No.: US 6,431,102 B1
(45) Date of Patent: Aug. 13, 2002

(54) APPARATUS FOR GUIDING AND STOPPING AN ANCHOR CHAIN ON A FLOATING STRUCTURE

(75) Inventors: Sigmund Askestad, Saetre; Laszlo Jurics, Arendal, both of (NO)

(73) Assignee: Den Norske Stats Oljeselskap A.S, Stavanger (NO)

( * ) Notice: Subject to any disclaimer, the term of this patent is extended or adjusted under 35 U.S.C. 154(b) by 0 days.

(21) Appl. No.: 09/786,496

(22) PCT Filed: Sep. 2, 1999

(86) PCT No.: PCT/NO99/00272

§ 371 (c)(1),
(2), (4) Date: May 29, 2001

(87) PCT Pub. No.: WO00/13963

PCT Pub. Date: Mar. 16, 2000

(30) Foreign Application Priority Data

Sep. 3, 1998 (NO) ..... 984042

(51) Int. Cl.[7] ..... B63B 21/18
(52) U.S. Cl. ..... 114/200
(58) Field of Search ..... 114/199, 200, 114/294, 182; 24/116 R

(56) References Cited

U.S. PATENT DOCUMENTS

| | | | | | |
|---|---|---|---|---|---|
| 13,760 | A | * | 11/1855 | Perley | 114/200 |
| 2,448,482 | A | * | 8/1948 | Woolslayer et al. | 24/116 R |
| 2,652,018 | A | * | 9/1953 | Griffith | 114/180 |
| 3,289,626 | A | * | 12/1966 | Petrie et al. | 114/200 |
| 3,557,737 | A | * | 1/1971 | Smulders | 114/200 |
| 3,638,599 | A | * | 2/1972 | Nilsen | 114/200 |
| 4,159,849 | A | * | 7/1979 | Rehbein | 299/34 |
| 4,186,464 | A | * | 2/1980 | Sandoy | 24/116 R |
| 4,742,993 | A | | 5/1988 | Montgomery et al. | |
| 5,934,216 | A | * | 8/1999 | Childers et al. | 114/230.1 |

FOREIGN PATENT DOCUMENTS

| | | | | |
|---|---|---|---|---|
| DE | 299911 | | 8/1917 | |
| DE | 2548569 | * | 6/1976 | 114/199 |
| EP | 217761 | * | 4/1987 | 114/200 |
| FR | 2 601 332 | | 1/1999 | |
| GB | 954104 | | 4/1964 | |
| GB | 2174041 | * | 10/1986 | 114/294 |
| SU | 417339 | * | 9/1974 | 114/200 |

* cited by examiner

*Primary Examiner*—S. Joseph Morano
*Assistant Examiner*—Ajay Vasudeva
(74) *Attorney, Agent, or Firm*—Scully, Scott, Murphy & Presser

(57) ABSTRACT

An apparatus for guiding and stopping an anchor chain on a floating structure, wherein the chain (13) comprises links (17, 19) forming a catenary plane between the structure and an anchor. Standing chain links (17) and lying chain links (19) are guided by through a mouthpiece (10) with an inner guide passage (14) of generally cruciform cross-section. The standing chain links and the lying chain links are received in pairs of opposite grooves (16, 18) in first and second arms of the cruciform. Each arm has a constant width transversely to the catenary plane but diverges in direction towards the anchor. Link supporting surfaces in the opposite grooves (18) of the second arm cooperate in pairs and have planar surface portions (22) to support individual lying links when the chain (13) is stopped by stopper (12).

11 Claims, 5 Drawing Sheets

APPARATUS FOR GUIDING AND STOPPING AN ANCHOR CHAIN ON A FLOATING STRUCTURE

The invention relates to an apparatus for guiding and stopping an anchor chain on a floating structure, wherein the chain comprises links extending like a catenary between the structure and an associated anchor, the apparatus comprising a means for guiding standing chain links and guiding and supporting lying chain links, and a stopper for retaining the chain in a desired position.

In anchor systems for the anchoring of floating structures, such as offshore platforms or vessels for hydrocarbon recovery, the anchor chains preferably are terminated above water or easily accessible, whereas they should preferably be guided into the floating structure or vessel under water. Guide wheels are then used to terminate the catenary course, for thereafter to carry the chain further alongside or internally of the structure up to a suitable place for the chain stopper.

In this connection, according to the practice of today, there are used either 1) so-called "fairleads" in the form of blade wheels or guide wheels having pockets which are adapted for receiving individual chain links, or 2) fixed guide disks having a constant radius of curvature as viewed into the catenary plane.

The guide wheels are advantageous in applications wherein frequent anchor line operations occur. The guide wheels have pockets for the lying chain links and grooves for the standing chain links, something which gives a good support for guiding of the chain links. A drawback of the guide wheels is, however, that they become very large.

The fixed guide disks consist of a segment having a fixed radius of curvature. The curvature in the catenary plane may, e.g., have a radius of curvature of about 3 555 mm for a chain having a thickness of 102 mm (see U.S. Pat. No. 4,742,993). The drawback of the fixed guide disk is that the chain links will be "riding" on the curved surface of the lying links in the operating condition, something which results in undesirably large stresses in the chain links.

The object of the invention is to provide a guide means for the current purpose which is less space-demanding than the above-mentioned guide wheels, which does not require any bearing as is necessary to rotate a guide wheel, and wherein the construction is designed in such a manner that the additional stresses in the chain links will be small.

For achieving the above-mentioned object there is provided an apparatus of the introductorily stated type which, according to the invention, is characterized in that the guide means comprises a mouthpiece member having an inner guide passage with a generally cruciform cross-section with a first arm having a pair of opposite grooves for the receipt of standing chain links, and a second arm having a pair of opposite grooves for the receipt of lying chain links, wherein each arm has a constant width transversely to the catenary plane of the chain, but diverges in the catenary plane in the direction towards the catenary part of the chain, the opposite grooves of the second arm having lying link supporting surfaces cooperating in pairs and of which at least one pair comprises one or more planar surface portions having a length which is adapted to support individual, lying chain links when the chain is retained in the desired position by means of the chain stopper.

In an advantageous embodiment of the apparatus, each of the opposite diverging supporting surfaces is provided with said planar surface portions. Further, it is advantageous that the planar surface portions have a length corresponding to the nominal chain length plus an additional length determined by the length tolerance of the chain. Further, the planer surface portions of the associated supporting surface preferably are connected to each other through single-curved surface portions.

The guide means according to the invention allows the use of a smaller angular change between adjacent chain links than in a guide wheel (fairlead), so that the equivalent diameter for a corresponding guide wheel becomes larger. A guide wheel usually is executed with seven pockets. With an embodiment in which the guide means according to the invention is mounted in a suitable inclined position adapted to the chain course, one can easily obtain an equivalent diameter corresponding to a guide wheel having twenty pockets.

As will be known to a person skilled in the art, a chain is delivered with a certain length tolerance for the chain links. When considering a guide wheel having teeth which are placed pursuant to the length of the links, one will face one of two cases: In one case the chain is short, and it will then rest against a planar surface in a corresponding manner as in the guide means according to the invention. In the other case the chain is long in relation to the pocket, and the chain then will get jammed between the teeth. This will not happen in the guide means according to the invention. It is therefore likely that the chain links will have better supporting conditions in the present guide means than in a guide wheel according to the prior art.

The invention will be further described below in connection with exemplary embodiments with reference to the drawings, wherein FIG. 1 shows a schematic view of a part of a floating structure which is provided with two apparatuses according to the invention;

Figure 1:
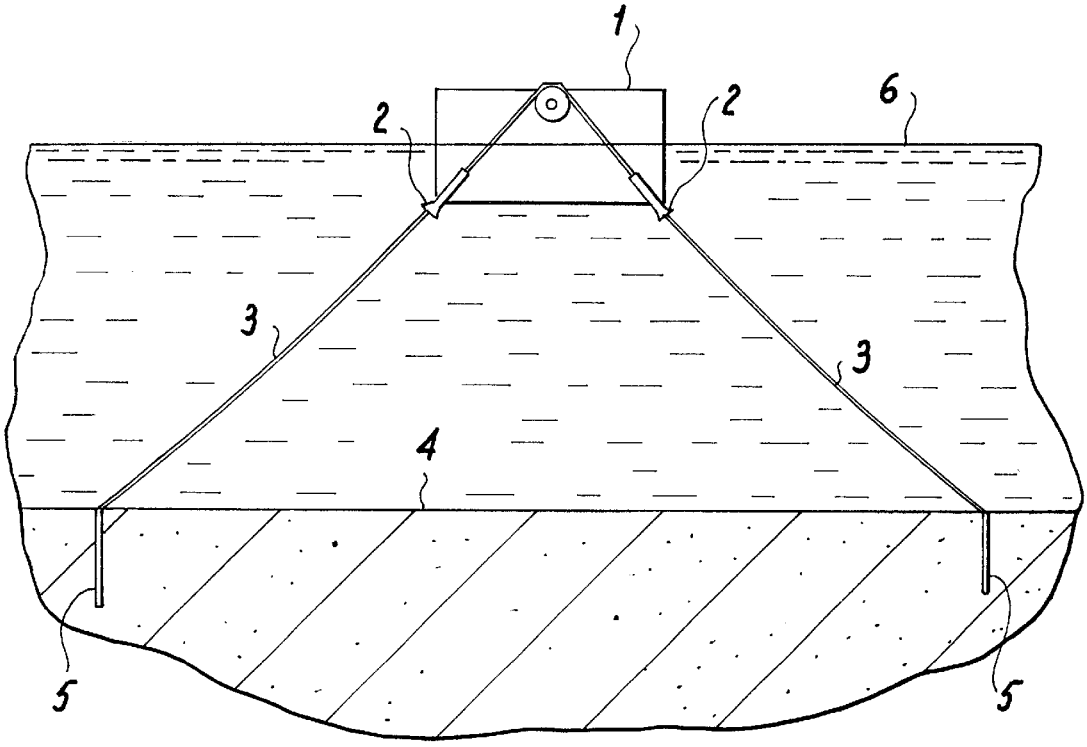

In the schematic view in FIG. 1 there is suggested a floating structure 1 which, e.g., may be a platform, a ship or a loading buoy. In the floating structure there is shown to be mounted a pair of apparatuses 2 according to the invention, the mouthpiece members of the apparatuses being suitably inclined in relation to the course of the associated chain 3 extending in a catenary manner between the floating structure and the sea bed 4. The lower end of each chain is connected to an anchor 5 anchored in the sea bed 4, whereas the upper ends of the chains are suitably terminated above the water surface 6, the chains being retained in a tightened position by means of an associated chain stopper (not shown).

Figure 2:
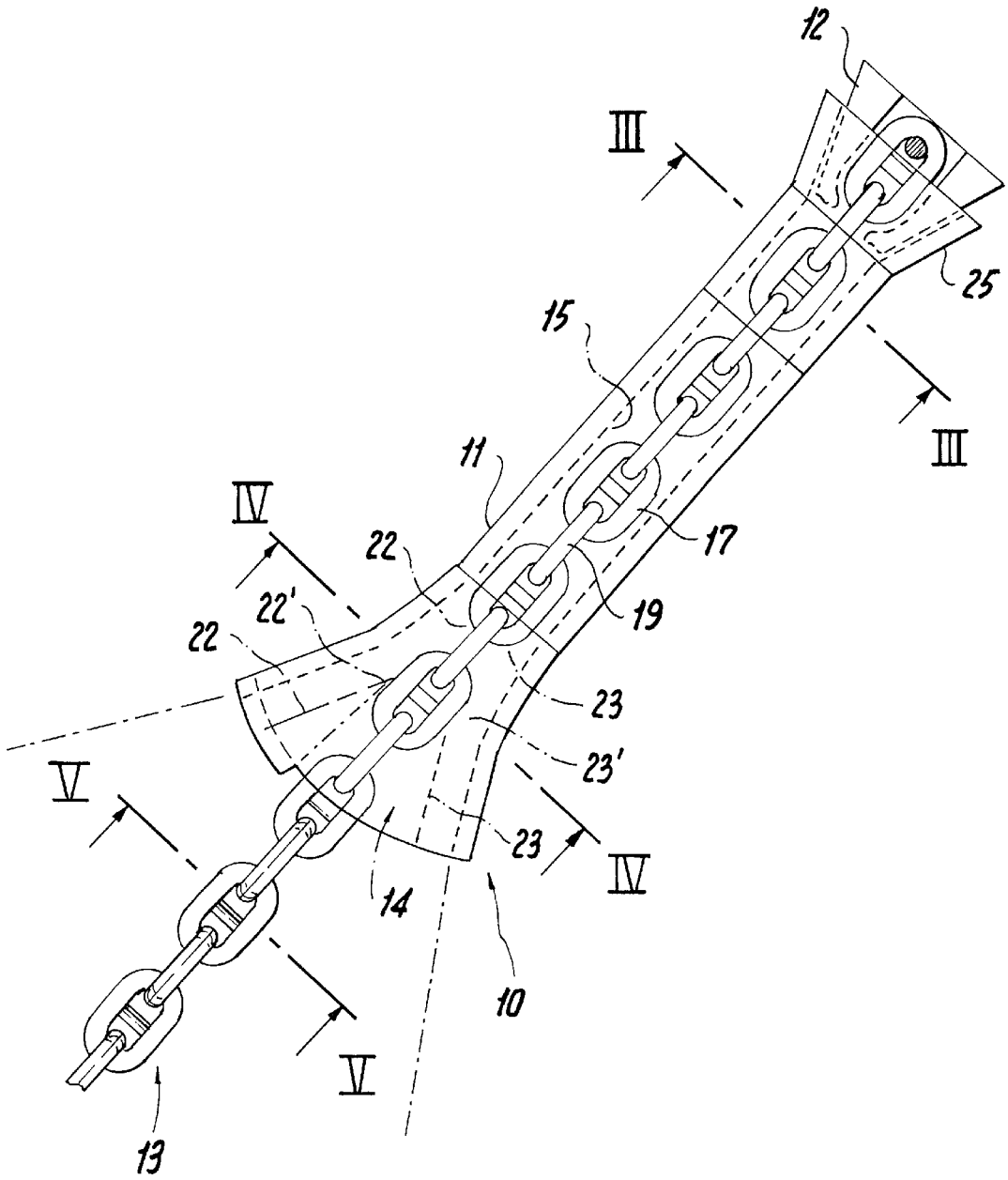
FIG. 2 shows a longitudinally partly sectioned view of a first embodiment of the apparatus according to the invention.

The embodiment of the apparatus shown in FIG. 2 comprises a mouthpiece member 10 which, in the drawing plane, is outwardly flared towards the lower end, but has a constant width normal to the drawing plane. At its upper end, the mouthpiece member is connected to the lower end of a pipe member 11. The upper end of the pipe member is conically widened and receives a chain stopper 12 for retention of a chain 13 which is carried through a specially designed, inner guide passage 14 in the mouthpiece member 10 and a passage 15 in the pipe member 11 continuous therewith.

Figure 3:
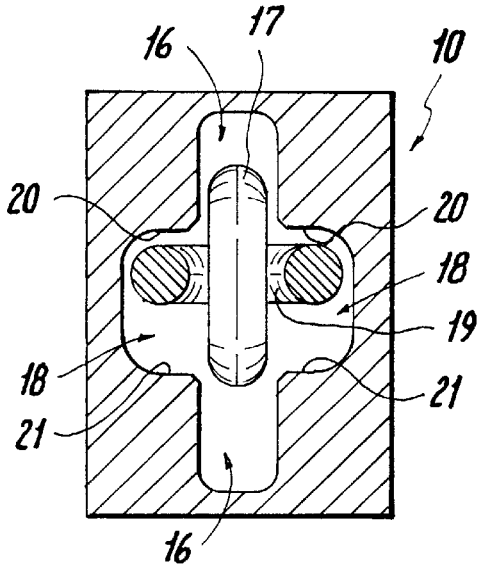
FIGS. 3, 4 and 5 show enlarged sectional views along respective lines III—III, IV—IV and V—V in FIG. 2.
Figure 4:
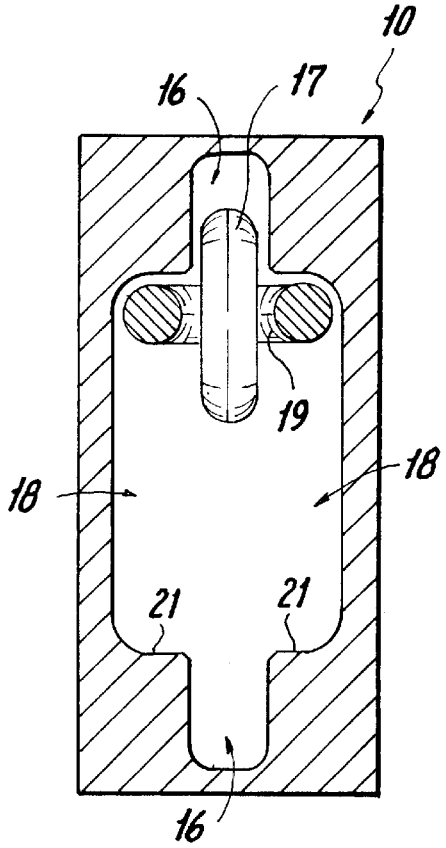
Figure 5:
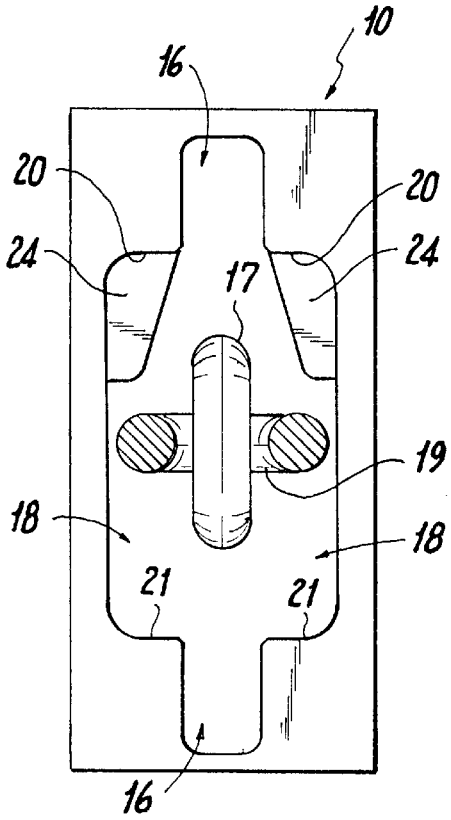

FIGS. 3 and 4 show cross-sections of the guide passages 14 and 15, and FIG. 5 shows a view as viewed towards the free end of the mouthpiece member 10. The cross-section shown in FIG. 3 of the guide passage 15 through the pipe member 11 corresponds to the cross-section of the guide passage 14 through the mouthpiece member 10 where this passes into the passage 15.

As appears from the sectional views, the guide passage 14 has a generally cruciform cross-section with a first arm having a pair of mutually opposed grooves 16 for the receipt of standing chain links 17, and a second arm having a pair of mutually opposed grooves 18 for the receipt of lying chain links 19. Each arm has a constant width transversely to the catenary plane of the chain 13, i.e. perpendicularly to the drawing plane in FIG. 2, but diverges in the catenary plane in the direction towards the end of the mouthpiece member 10 facing the catenary part of the chain. The width of the first arm transversely to the catenary plane corresponds to the thickness of the chain links 17 and 19 with the addition of a suitable clearance, and the width of the second arm corresponds to the width of the chain links with the addition of a suitable clearance.

The opposite grooves 18 of the second arm have lying link supporting surfaces 20 and 21, respectively, cooperating in pairs, for possible support of lying chain links 19. In the embodiment shown in FIG. 2, each link supporting surface of each of the two pairs of cooperating link supporting surfaces 20 and 21, respectively, comprises a pair of planar surface portions 22 and 23, respectively, having a mutual angular change and having a length which is adapted for support of individual, lying chain links when the chain is retained in the desired position by means of the chain stopper 12. The guide means may comprise one or more such pairs of planar surface portions, dependent on how large angular change the anchor chain is expected to get in relation to the floating structure, and how large angle the individual surface portions is to have in relation to each other. This angle difference between the successive planar surface portions 22 or 23 is made smaller the smaller wear and additional loads are sustained by the individual chain links.

As appears from FIG. 2, the planar surface portions 22 and 23, respectively, of each link supporting surface 20 and 21, respectively, are connected to each other through single-curved surface portions 22' and 23', respectively, to allow the chain is links to slide thereover in connection with pull-in of the chain.

As will be understood, lying chain links 19 will rest against the upper planar surface portions 22 when pulling in and tightening the chain, whereas the chain will be able to slide along the lower planar surface portions 23 when easing-off the chain. Since the load in the anchor chain is largest when its angle of inclination is smallest, it is natural that the angular differences between the surface portions 22 at the upper side of the guide passage 14 are small. On the other hand, at the underside of the guide passage, where the tension forces in the chain normally are smaller, the angular differences between the surface portions 23 may be made larger. If it is found to be appropriate, the link supporting surfaces 21 at the underside possibly may be continuously curved, without planar surface portions, since the chain links will not rest against the lower link supporting surfaces when the links are subjected to large tensile stresses in the tightened condition of the chain.

As suggested in FIGS. 2 and 5, at the free end of the upper pair of link supporting surfaces 20, which are to support the lying chain links when the chain 13 is tightened, there are arranged a pair of opposite guide surface portions 24 for guiding of the standing chain links 17 into the associated groove 16 of the first arm of the cross-section of the guide passage 14. In this manner it is secured that the chain links are introduced in the correct manner into the associated grooves in the guide passage, even if the chain should happen to be twisted at the entrance to the guide passage.

As regards the pipe member 11, the guide passage 15 thereof has a cross-section corresponding to and passing into the adjacent cross-section of the passage 14 of the mouthpiece member 10. Even if it may be advantageous that the pipe member has such a passage cross-section over its entire length, it is sufficient that it has such a portion at its lower end, and preferably also at its upper end where the pipe member passes into a conically widened portion or funnel portion 25 for the receipt of the chain stopper 12.

The chain stopper 12 may be of different designs, and possibly of a standard design which is commercially available. The illustrated embodiment is based on the use of a pair of equal halves or cup members having an inner shape corresponding to the shape of the chain links, and an outer shape which is adapted for rest against the funnel portion 25 of the pipe member when the chain 13 is locked. The mechanism controlling the lock may be of a known type, and is therefore not further shown and described.

The chain stopper 12 and the pipe member 11 together with the mouthpiece member 10 advantageously is inclined as appears from FIG. 2, preferably with an inclination corresponding to the inclination of the anchor chain in usual operational conditions.

As mentioned above, a chain is delivered with a certain length tolerance. The normal length tolerance for a chain is indicated as −0/+2.5%. The length of the planar surface portions 22 or 23 then will correspond to the nominal length of the lying links plus and additional length corresponding to the tolerance of the total length of the chain from the considered, lying link up to the chain stopper 12. Stated differently, the upper end of each of the planar surface portions will begin at a length corresponding to the relevant number of links times the nominal link length. The lower end of each of the planar surface portions ends at a length corresponding to said nominal length plus an extra link length plus the tolerance addition (i.e. 2.5% of the nominal chain length from the considered link up to the chain stopper).

As regards the length of the pipe member 11, this may be chosen so that the chain stopper can be placed at a desired level in the structure.

Figure 6:
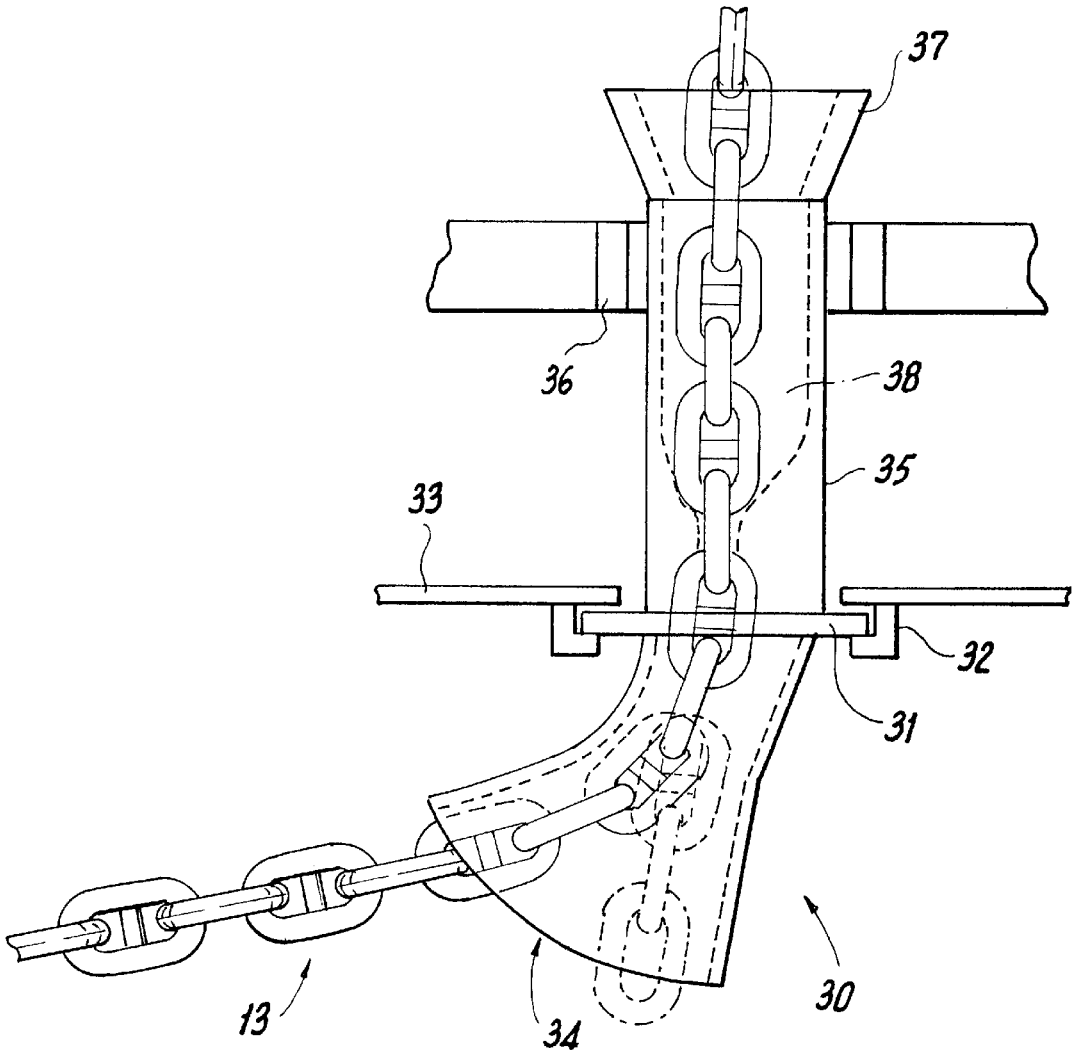
FIG. 6 shows a longitudinally partly sectioned view of an alternative embodiment of the apparatus according to the invention.

An alternative embodiment of the apparatus according to the invention is shown in FIG. 6. In this embodiment a mouth piece member 30 at the upper or non-flared end is provided with a peripheral ring flange 31 which is rotatably mounted in a bearing means 32 arranged under the bottom 33 of a turret which is not further shown. The mouthpiece member 30 has a guide passage 34 which is shaped in a manner corresponding to that of the guide passage 14 in the mouthpiece member 10. As shown, the mouthpiece member 30 is inclined in relation to the horizontal ring flange 31, so that it can rotate to a desired inclined orientation in the water.

Over the ring flange 31 there is mounted a pipe member 35 which, in this embodiment, is vertical and at its upper end is laterally supported by a bearing means 36. The pipe member 35 has an upper funnel portion 37 for the receipt of a chain stopper (not shown), in a corresponding manner as in the embodiment according to FIG. 2. The passage 38 of the pipe member for the chain 13 in this embodiment has a cross-section corresponding to the cross-section of the passage 34 through the mouthpiece member 30 only in a lower portion of the pipe member.

Figure 7:
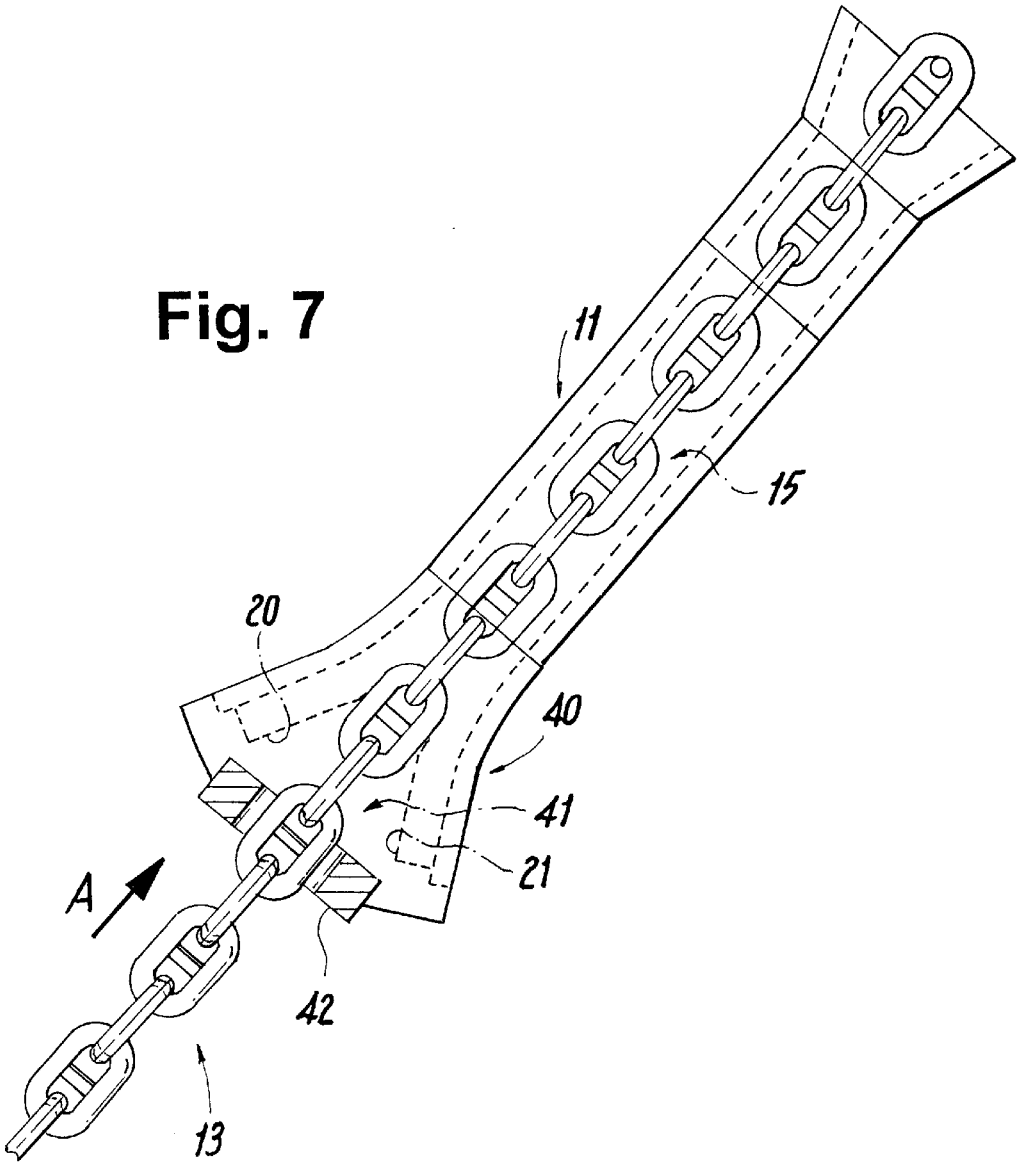
FIG. 7 shows a view corresponding to that of FIG. 2, but of an embodiment which is provided with an extra guide member for the chain.
Figure 8:
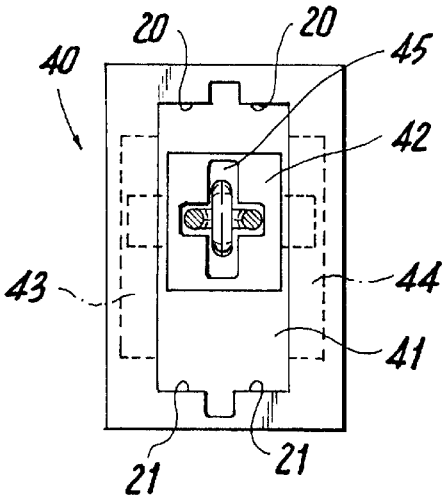
FIG. 8 shows a view as viewed in the direction of the arrow A in FIG. 7.

FIGS. 7 and 8 show an embodiment generally corresponding to the embodiment in FIG. 2, but wherein the mouthpiece member 40 at the diverging end is provided with a separate guide means for the chain 13. Thus, at the free end of the passage 41, there is provided a separate guide member 42 which is displaceably mounted in a pair of parallel guide grooves 43, 44 in opposite end walls of the mouthpiece member 40, so that the guide member is displaceable in the region between the link supporting surfaces 20 and 21. The guide member 42 is provided with a through opening 45 having a cross-section corresponding to the cross-section of the guide passage 41 at the other or upper end of the mouthpiece member 40. As will be understood, the guide member 42 replaces the guide surface portions 24 in the embodiment according to FIG. 2, and secures that the chain links are introduced with the correct orientation in the associated grooves in the guide passage 41.

What is claimed is:

1. An apparatus for guiding and stopping an anchor chain on a floating structure, wherein the chain comprises standing links and lying links extending in a catenary plane between the structure and an associated anchor, the chain including a length tolerance, the apparatus comprising:

a guiding means for guiding standing chain links, and guiding and supporting lying chain links, said standing chain links and said lying chain links each formed of a structural member defining an interior space for engaging said standing chain links and said lying chain links to one another, said interior space defining a cross-width, said structural member including a cross-sectional thickness, a length, and a cross-width, said cross-width of said structural member including said cross-width of said interior space, and a chain stopper for retaining the chain in a desired position, the guiding means including a mouthpiece member, the mouthpiece member including an inner guide passage with a generally cruciform cross-section with a first arm including a pair of opposite grooves for receipt of the standing chain links, and a second arm including a pair of opposite grooves for receipt of the lying chain links, the mouthpiece member having an inner end and an outer end, wherein each arm has a constant width transversely to the catenary plane of the chain, but diverges in the catenary plane in a direction towards the anchor, from the inner end to the outer end of the mouthpiece member, the opposite grooves of the second arm including lying link supporting surfaces cooperating in pairs and of which at least one pair comprises several successive planar surface portions having a length adapted to support individual, lying chain links when the chain is retained in the desired position by means of the chain stopper, the planar surface portions having a mutual angular change in the catenary plane which is determined by angular change of the anchor chain in relation to the floating structure.

2. An apparatus according to claim 1, CHARACTERIZED IN that the width of the first arm transversely to the catenary plane corresponds to the cross-sectional thickness of the structural members of the standing chain links with addition of a suitable clearance, and the width of the second arm corresponds to the cross-width of the structural members of the chain links with addition of a suitable clearance.

3. An apparatus according to claim 1, CHARACTERIZED IN that each of the two pairs of cooperating link supporting surfaces is provided with said planar surface portions.

4. An apparatus according to claim 1, CHARACTERIZED IN that the planar surface portions have a length corresponding to the length of the structural member of the lying chain link plus an additional length determined by the length tolerance of the chain.

5. An apparatus according to claim 1, CHARACTERIZED IN that the planar surface portions of each link supporting surface are connected to each other through single-curved surface portions.

6. An apparatus according to claim 1, CHARACTERIZED IN that the mouthpiece member at the inner end is provided with a peripheral ring flange for rotatable mounting in a bearing means in the floating structure.

7. An apparatus according to claim 6, CHARACTERIZED IN that the passage of the mouthpiece member is inclined in relation to the axis of rotation of the ring flange.

8. An apparatus according to claim 1, CHARACTERIZED IN that the mouthpiece member at the inner end is connected to one of two ends of a pipe member including an inner guide passage passing into the inner guide passage of the mouthpiece member, and that the chain stopper is arranged at the other end of the pipe member.

9. An apparatus according to claim 8, CHARACTERIZED IN that the inner guide passage of the pipe member has a cross-section corresponding to the adjacent cross-section of the inner guide passage of the mouthpiece member.

10. An apparatus according to claim 1, CHARACTERIZED IN that, at a free end of the pair of link supporting surfaces which is intended to support the lying chain links when the chain is tightened, there are provided mutually opposed guide surface portions for guiding of the standing chain links into the associated groove of the first arm of the cross-section of the inner guide passage of the mouthpiece member.

11. An apparatus according to claim 1, CHARACTERIZED IN that, at a free end of the pairs of link supporting surfaces, there is provided a separate guide member which is mounted in the mouthpiece member so that it is displaceable in the region between the link supporting surfaces, the separate guide member being provided with a through opening having a cross-section corresponding to the cross-section of the passage of the mouthpiece member at the inner end thereof.

* * * * *